US005215306A

United States Patent [19]

Cayce

[11] Patent Number: 5,215,306

[45] Date of Patent: Jun. 1, 1993

[54] GOLF SWING TRAINING AID

[76] Inventor: Kent A. Cayce, 9200 Bent Ridge Ave., Potomac, Md. 20854

[21] Appl. No.: 765,309

[22] Filed: Sep. 25, 1991

[51] Int. Cl.[5] ..... A63B 57/00

[52] U.S. Cl. ..... 273/186.1; 273/191 R

[58] Field of Search ..... 273/68, 186 R, 186 C, 273/186 A, 191 R, 191 A, 191 B, 67 A; 135/75-81, 17, 18, 66, 67; 434/252

[56] References Cited

U.S. PATENT DOCUMENTS

| | | | |
|---|---|---|---|
| 720,406 | 2/1903 | Clifford | 273/186 R |
| 847,066 | 3/1907 | Hall | 135/66 X |
| 1,591,333 | 7/1926 | Neidlinger | 135/66 |
| 1,854,392 | 4/1932 | Bambrick | 273/191 A |
| 2,005,507 | 6/1935 | Russell et al. | 135/78 X |
| 2,257,326 | 9/1941 | Blum | 273/68 |
| 2,596,733 | 5/1952 | Sibner | 135/81 |
| 3,109,244 | 5/1963 | Trifaro et al. | 434/252 |
| 3,510,135 | 5/1970 | Gentile | 273/186 R |
| 3,940,134 | 2/1976 | Bieganowski | 273/67 A |
| 4,052,059 | 10/1977 | Rigsby | 273/67 A |
| 4,583,738 | 4/1986 | Fava | 273/186 C |
| 4,718,674 | 1/1988 | Henry | 273/186 C |
| 4,736,952 | 4/1988 | Taft et al. | 273/186 R X |
| 4,809,975 | 3/1989 | Lee | 273/193 A X |
| 4,858,926 | 8/1989 | Cabianca | 273/68 |
| 4,896,687 | 1/1990 | Segal et al. | 135/75 |
| 4,927,152 | 5/1990 | Graham | 273/186 R |
| 5,005,836 | 4/1991 | Nelson | 273/191 R |
| 5,013,044 | 5/1991 | Hesselbart | 273/186 C |

*Primary Examiner*—Millin V.
*Assistant Examiner*—William E. Stoll
*Attorney, Agent, or Firm*—N. J. Aquilino

[57] ABSTRACT

A golf swing training device for teaching a golfer the proper swing plane, including an elongated shaft member which is positioned in the ground next to the golfer during the execution of a golf swing, and an obstruction which is adjustable along the longitudinal axis of the shaft. The obstruction interferes with the club as it is swung in the backswing and deflects the club upwardly to the proper position at the top of the backswing. The downswing is made inside the elongated shaft to ensure a proper inside-out swing plane.

4 Claims, 2 Drawing Sheets

GOLF SWING TRAINING AID

BACKGROUND AND SUMMARY OF THE INVENTION

The present invention relates to a golf swing training aid, and in particular, to a training aid for teaching a golfer the proper swing plane for executing a golf swing.

It has long been recognized that there is an inherent difficulty in swinging a golf club in the proper swing plane because of the natural tendency of most golfers to use their hands and upper body during the execution of a golf stroke. Because of this difficulty, simply being aware that a club is not being properly swung does not always enable a golfer to make the necessary corrections to improve the swing. Rather, repetitive practice in the proper execution of a golf swing is needed in order to reprogram the neuro-muscular systems in order that the proper muscle memory be created to insure that good golf swings are consistently made, particularly in situations where tension and similar emotional stresses are encountered during the playing of a round of golf. Providing a golfer with feedback orally, such as by an instructor or coach, or visually by a videotape and the like, has been found to be insufficient to provide the necessary training to develop swing changes. For this reason, the prior art includes a number of teaching devices for teaching the golf swing which use mechanical swing guide structures to provide immediate feedback to the golfer as the club is being swung, to teach the proper swing action.

For example, the U.S. Pat. No. to Clifford (720,406) shows a golf swing training device, including a pair of upright stands, using horseshoe-shaped members through which the club head is to be swung in order for it to be in the proper swing plane. The Herold patent (U.S. Pat. No. 3,138,388) discloses a device for coordinating the pivotal movement of a golfer's shoulders and hips using an upright and angularly adjustable obstruction mechanism mounted to a support base. The Panza patent (U.S. Pat. No. 3,375,010) shows a golf swing training device, including a rod-like element which is mounted by a ground engaging support over the golf ball to be struck. The U.S. Pat. No. to Swanson (3,880,431) shows another training device, including an elongated shaft which is adjustable in length and which includes a ball on an activating arm which engages the forehead of the golfer to teach the golfer to keep his head still during a swing. The Otting et al. patent (U.S. Pat. No. 4,758,001) shows a golf practice aid for teaching the golfer a proper leg movement using a frame and an elongated pivotable arm used as a leg guide. The Bechler et al. patent (U.S. Pat. No. 4,699,384) shows a training device for a golf swing, including a base and a spatially positioned guide means which interacts with the face of the club, including two rods disposed at an angle to each other, one in the form of an arched segment, and the other being straight and extending parallel to the target line. The device also includes a guide means having an obliquely, upwardly extending barrier rail delineating the path of the upstroke.

The Henry patent (U.S. Pat. No. 4,718,674) shows a training device, including a rectangular frame having foot markers, a ball placement marker, and a graduated bar which extends upwardly and at an adjustable angle for measuring the golfer's back swing. The Graham patent (U.S. Pat. No. 4,927,152) shows a golf swing aid formed of spaced-apart U-shaped members which are engaged into the ground surface, which form a channel or path through which the club is swung.

Another patent, to Waller (U.S. Pat. No. 4,993,716) shows a golf stance alignment device having adjustable members which touch the knees and shoulders of the golfer.

These are merely representative of a number of golf swing training aids which are known in the prior art.

The present invention is directed to a golf swing training aid for teaching a golfer the proper swing plane by providing the necessary feedback to reprogram the neuro-muscular systems of the body to ensure consistent repetitive golf swings. The device provides immediate feedback, since the golf club contacts the training device during the execution of the swing, thereby ensuring the proper placement of a golf club during the swing process. In a preferred embodiment, an elongated shaft is structured to be inserted into the ground adjacent the right side of the player at a specific angle relative to a golfer using the device. The shaft includes an obstruction which is adjustably positioned along the longitudinal axis of the shaft. Preferably, the end of the shaft would include a stake or other pointed structure to enable it to be easily inserted into the turf adjacent the player when in use. Preferably, the obstruction is slidable along the shaft, thereby enabling precise positioning of the obstruction to accommodate the physical variations between individuals using the device.

In use, the device is inserted into the ground at an angle consistent with the proper angle of a swing normally executed by the player. The obstruction is positioned vertically so that it is approximately opposite the right hip of the golfer when he is in position to hit a golf ball. During the initial part of the back swing, the shaft of the golf club contacts the shaft of the training aid inserted into the ground. The golf club shaft moves upwardly along the shaft of the training aid and encounters the obstruction. At this point in the swing, the club head is deflected to a more upright position, thereby setting the golf club in the proper position at the top of the swing. During the downswing, the golfer trains himself to swing the club under the shaft of the training aid to ensure a proper inside-out swing motion.

In a preferred embodiment, the obstruction is elliptical in shape. The center of the obstruction would include a hole which permits its movement longitudinally along the axis of the shaft. Preferably, the obstruction would be somewhat resilient to minimize the shock of the shaft striking it during the execution of the swing.

A second embodiment contemplates the use of an adjustable shaft having one end which is insertable into the turf, and an opposite end having an obstruction permanently affixed thereto. The shafts would be telescopically adjustable, which will regulate the position of the obstruction relative to a golfer using the training aid. It will be appreciated that this embodiment works essentially the same as the first embodiment described herein above.

Among the objects of the present invention are the provision of a golf swing training aid which will teach a golfer proper swing plane by providing feedback as the club is swung. Another object of the invention is the provision of a golf training aid wherein the golf ball is struck when using the device so the flight path and direction may be evaluated in combination with the tactile feedback provided by the training aid. Another object is the provision of a golf swing training aid which is simple in design, inexpensive and portable so that it can be easily carried by a golfer along with his golf equipment to a practice facility of his choice.

These and other objects and advantages of the invention will be set forth in part in a description which follows, and in part will be obvious from the description or may be learned by practice of the invention.

It is to be understood that both the foregoing general description and the following detail description and exemplary and explanatory only, and are not restrictive of the invention as claimed.

The accompanying drawings, which are incorporated in and constitute a part of the specification, illustrate the invention, and together with the description, serve to explain the principles thereof.

DESCRIPTION OF THE PREFERRED EMBODIMENTS

Figures 1, 2:
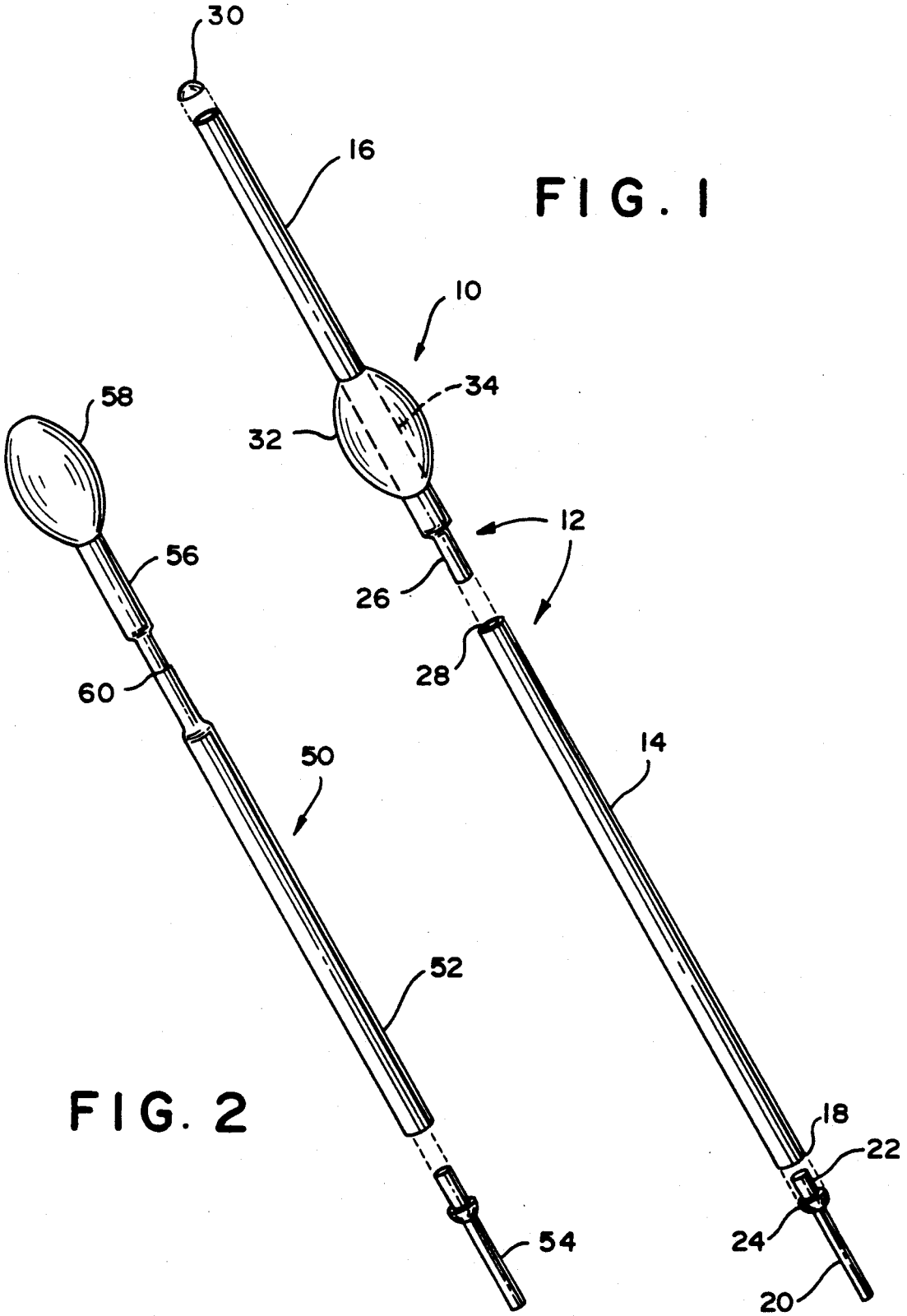
FIG. 1 shows the first embodiment of a golf swing training device of the present invention.
FIG. 2 shows a second embodiment of the present invention.

FIG. 1 shows a first embodiment f a golf swing trainer 10 of the present invention. The trainer 10 is formed of an elongated shaft 12, including a lower shaft section 14 and upper shaft section 16. The distal end 18 of the shaft 12 is provided with a ground attachment 20, and is telescopically connected to the lower shaft section 14 by a connector 22, and maintained in place by stabilizing collar 24. The upper and lower shaft sections 14 and 16 are longitudinally connected using a telescoping connector 26 formed on the end of the upper shaft section 16 and structured to fit within an opening 28 on the upper end of the lower shaft section 14. It will be appreciated that the two-piece structure of the shaft 12 facilitates transportation and storage. However, the trainer may be made using a single elongated shaft for handling when storage does not present a problem. An end cap 30 may be provided on the upper end of the upper shaft section 16.

An elliptical obstruction 32 is positioned on the shaft 12 and is moveable along the longitudinal axis of the shaft so that the obstruction 32 may be adjusted to accommodate the physical characteristics of the various golfers using the device. For example, a tall golfer would use the trainer 10 with the obstruction positioned vertically higher on the shaft 12 than a shorter golfer, for reasons that will become obvious with reference to the description of the device hereinbelow.

Preferably, the obstruction is made of a semi-rigid material, such as soft rubber or foam, to minimize the shock of the club coming in contact with it during the execution of a practice stroke. The obstruction is provided with a longitudinal opening 34 just slightly smaller than the outside diameter of the shaft 12 to enable the obstruction to be longitudinally moved upwardly and downwardly along the shaft for adjustment purposes. The size of the opening 34 and the material of the obstruction creates a frictional fit between the device and the shaft so that once the device is placed in a selected position on the shaft, it stays there until it is moved.

FIG. 2 shows a second embodiment of a golf swing trainer 50 of the present invention, including a lower shaft 52 having a ground engaging member 54 attached to the distal end thereof, and an upper shaft 56. An obstruction device 58 is permanently fixed to the upper end of the shaft 56. A telescoping connector 60 is formed between the lower shaft 52 and the upper shaft 56, which permits longitudinal adjustment between these members. By adjusting the relative position of the shaft members 52 and 56, the position of the obstruction device 58 is adjustable with respect to a golfer using the trainer 50.

Figure 3:
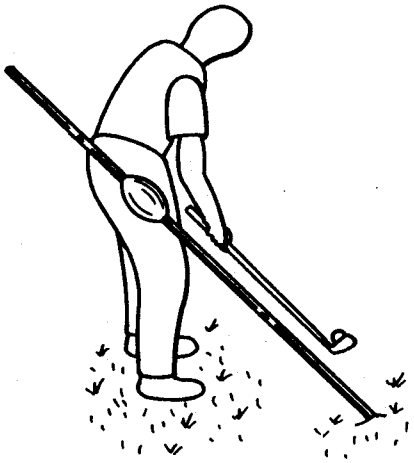
Figure 6:
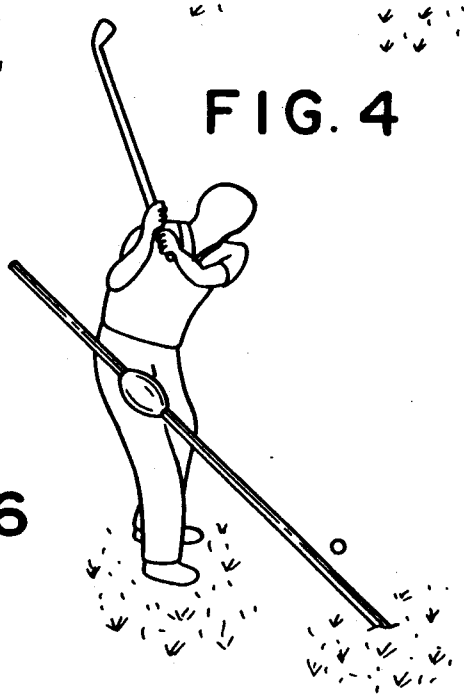

It will be appreciated that both of the embodiments described hereinabove are used in the same manner to provide feedback to a golfer during the execution of a practice stroke. FIGS. 3 through 7 show sequential views of a golfer using the trainer of the present invention. FIG. 3 shows the golfer in his normal address position before the start of the swing, with the trainer positioned across the normal swing plane angle used by the player. Preferably, the obstruction device is adjusted vertically on the shaft so that it is positioned approximately opposite the hip of the player.

Figure 4:
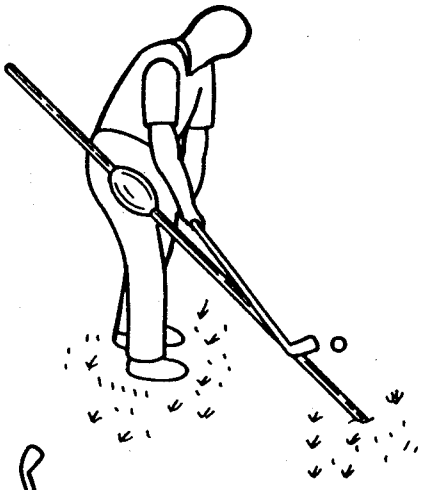
FIGS. 3 through 7 show pictorial, sequential views of a golfer using the invention during the execution of a practice shot.
Figure 5:
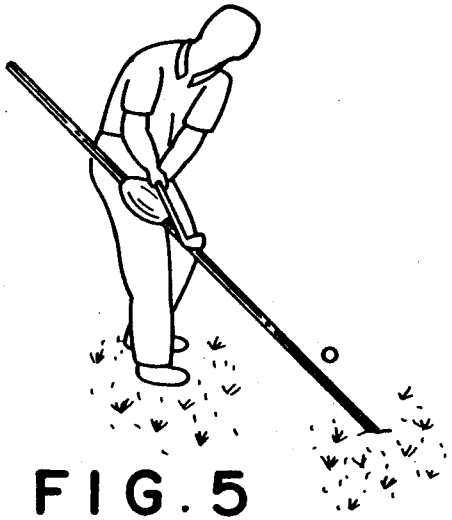
Figure 7:
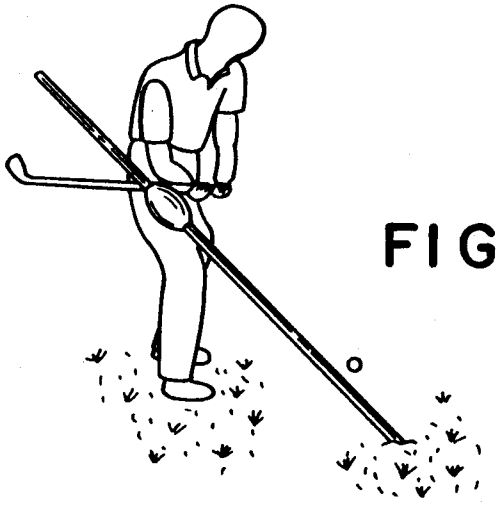

FIG. 4 shows the position of the golf club in the first portion of the backswing wherein the club shaft encounters the lower shaft of the trainer. As the player continues to swing the club, the golf club shaft rides along the shaft of the trainer until the obstruction is encountered, as shown in FIG. 5. When the shaft hits the obstruction, it is deflected upwardly at a steeper angle, thereby causing the player to set the golf club in the proper position at the top of the swing plane. See FIG. 6. During the downswing, the golfer trains himself to swing the club under the trainer, as shown in FIG. 7, thereby creating a proper inside-out swing plane, which contributes to more consistently struck golf shots.

Although the preferred embodiments of the present invention have shown the obstruction device to be elliptical in shape, it will be appreciated that other shapes are equally applicable in accordance with the present invention. For example, the obstruction device may be a round, conical or other geometrical shape appropriate to the various characteristics of users of the trainer. It will also be appreciated that while the present invention has been shown and described to provide a obstruction approximately halfway back in the backswing of a golfer, it is equally applicable to a variety of different golf swing positions by simply adjusting the position of the obstruction. For example, the obstruction may be placed lower or higher on the trainer if it is found that feedback in a particular swing area for a golfer would be a more valuable teaching aid. Similarly, the device may be used to contact various body parts of the golfer during the execution of a golf swing as a reminder to stay in the proper position during the swing process. For example, the obstruction may be positioned against the legs or hips of the golfer as a reminder of their proper position.

It will be apparent to those skilled in the art that various modifications and variations can be made in the golf swing training device of the present invention without departing from the scope or spirit of the invention. Other embodiments will be apparent to those of skill in the art from consideration of the specification and practice of the invention disclosed herein. It is intended that the specification and examples be considered as exemplary only with a true scope and spirit of the invention being defined by the following claims.

I claim:

1. A method of teaching a golfer a proper golf swing plane comprising the steps of:

angularly positioning an elongated shaft adjacent a golfer for defining a backswing plane of a golf swing; said elongated shaft structured to cooperate with a golf club swung by a golfer such that the golf club contacts the elongated shaft during the execution of a backswing portion of a golf swing;

guiding said golf club in said backswing plane by moving said golf club along said elongated shaft during a first portion of a backswing;

interrupting movement of said golf club along said backswing plane by striking an obstruction positioned on said elongated shaft; and, deflecting said golf club from said backswing plane upwardly at a steeper angle during a second portion of a backswing to a position at the top of the golf swing by the striking of the obstruction during the swing.

2. The method of claim 1 wherein the golf club contacts an upper surface of said elongated shaft during the execution of the backswing portion of the golf swing and further including the step of guiding the golf club in a swing path under said elongated shaft during a downswing portion of the golf swing.

3. The method of claim 1 further including the step of adjustably positioning said obstruction along a longitudinal axis of the elongated shaft to accommodate a particular golfer's swing characteristics.

4. The method of claim 1 further including the step of forming a smooth surface in the shape of an ellipsoid on said obstruction for interaction with a golf club during the swing.

* * * * *